United States Patent [19]

Fontaine

[11] 4,238,988

[45] Dec. 16, 1980

[54] DEVICE FOR RECEIVING AND HANDLING PROPELLANT POWDERS

[75] Inventor: Pierre Fontaine, Paris, France

[73] Assignee: Societe Nationale des Poudres et Explosifs, Paris, France

[21] Appl. No.: 970,141

[22] Filed: Dec. 18, 1978

[30] Foreign Application Priority Data

Dec. 23, 1977 [FR] France ..... 77 38952
Nov. 20, 1978 [FR] France ..... 78 32613

[51] Int. Cl.[3] ..... F42B 33/00; F42B 37/00
[52] U.S. Cl. ..... 86/1 R; 86/20 R
[58] Field of Search ..... 86/1 R, 20 R; 119/51 R

[56] References Cited

U.S. PATENT DOCUMENTS

| | | | |
|---|---|---|---|
| 463,857 | 11/1891 | Crabb | 119/51 R |
| 3,354,771 | 11/1967 | Stark | 86/20 C |
| 3,713,359 | 1/1973 | Andrew | 86/1 R |
| 3,713,360 | 1/1973 | Shansey | 86/1 R |
| 3,730,049 | 5/1973 | Andrew | 86/1 R |

*Primary Examiner*—Leland A. Sebastian
*Attorney, Agent, or Firm*—Bucknam and Archer

[57] ABSTRACT

The present invention relates to devices intended for receiving and handling a propellant powder, and especially to hoppers and containers for such a powder.

The hopper 1 for propellant powder 2 possesses an upper charging orifice 4 and a lower flow orifice 5 for the powder 2.

This hopper 1 comprises a side vent 13 possessing means for preventing the powder 2 from escaping through this vent; a zone 12 in the side wall of the hopper, which is located approximately between the vent 13 and the charging orifice 4, is made of a material which can be destroyed under the conjugate action of the pressure applied by the powder and the flames generated on the outside of the hopper near this zone 12.

9 Claims, 6 Drawing Figures

FIG. 3
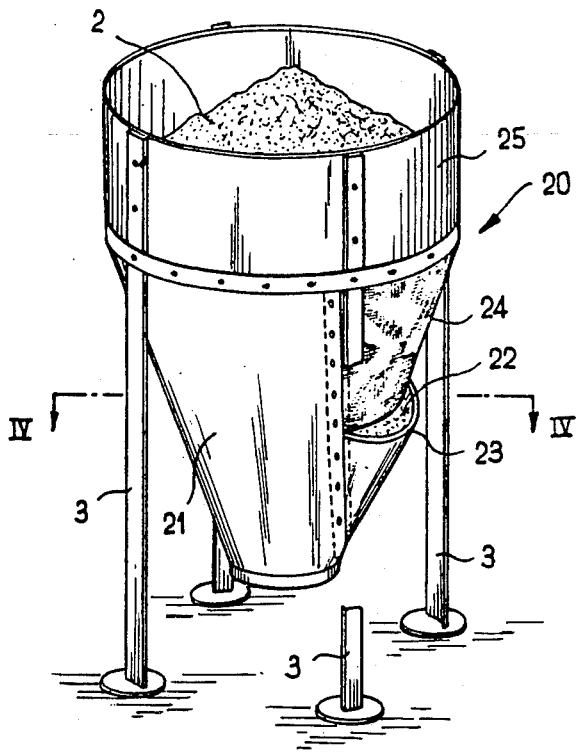
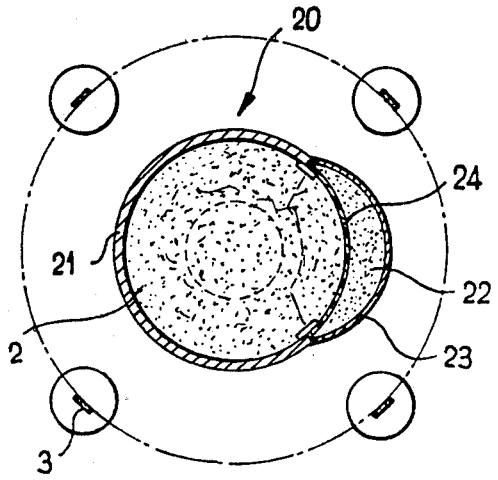
FIG. 4

FIG_5
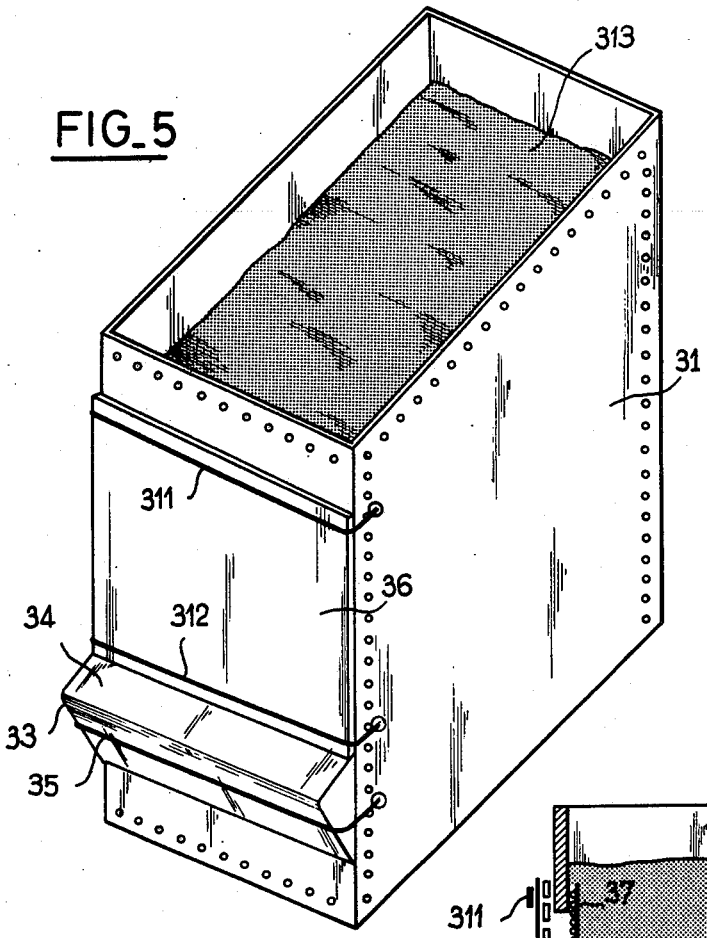
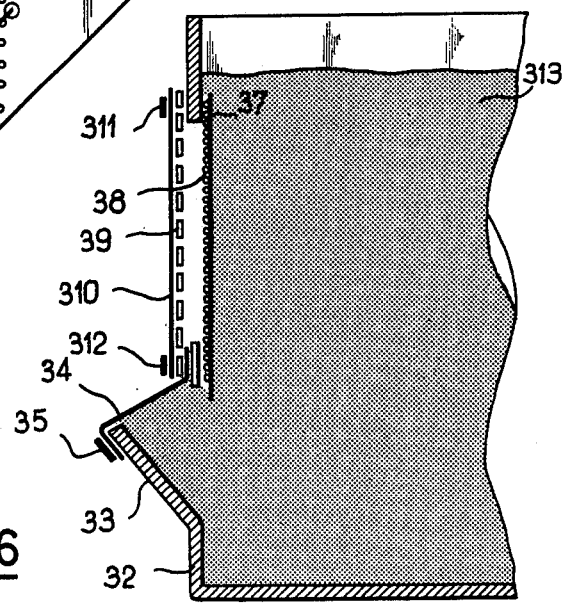
FIG_6

DEVICE FOR RECEIVING AND HANDLING PROPELLANT POWDERS

The present invention relates to devices intended for receiving and handling a propellant powder, and especially to hoppers and containers for such a powder.

When handling propellant powders, it is very frequently necessary to use hoppers which, in normal operation, can contain amounts of powder which, because of the great height of charging of the hopper, are likely to cause combustion or even explosions.

In fact, in the event of an accident caused by ingnition, the powder can either burn, or combust or, finally, explode, with all the resulting consequences.

Ignition generally occurs in the bottom of the hopper; it is caused, whilst the powder is flowing, by the rubbing of the particles against one another, which leads to point heating and electrostatic effects, and also by friction at the level of the valves or shutters.

It has been possible to observe experimentally that, for a certain type of powder which is commonly used, the critical height above which any ingnition causes at least one combustion is of the order of 0.2 to 0.3 meter, when the experiment is carried out in a tube having a diameter of 200 millimeters. Furthermore, the critical height above which any ignition causes an explosion is of the order of 0.7 to 0.8 meter, under the same experimental conditions as above.

Now, in order to operate below the critical combustion height, it would be necessary to construct hoppers of very low height, this being unacceptable for industrial purposes; similarly, it would not be very practical to use cascades of hoppers.

It is therefore necessary to be able to use hoppers of all types, and especially hoppers in the shape of truncated cones or pyramids, and to render them capable of containing amounts of powder, the height of which exceeds the critical value, whilst ensuring that they are very safe to use.

Hoppers are known which have walls produced from a latticed envelope made of expanded metal, wire netting or plastic, which is covered on the inside with a gauze of unoxidisable metal wire, the mesh size of which is less than the size of the grains of the powder used. Such hoppers are described, for example, in French Pat. No. 2,076,714.

In an arrangement of this kind, any excess pressure is released through the mesh of the gauze and the height of the powder in the hopper can be greater than the combustion height.

There are also hoppers which possess, on their walls, detachable panels which are distributed uniformly and are capable of detaching themselves in the event of excess internal pressure, in order to uncover 30 to 40% of the surface area of these walls. In this case, only the structure of the hopper remains in positions. Such hoppers are described, for example, in U.S. Pat. No. 3,730,049.

U.S. Pat. No. 3,713,359 also describes hoppers having a conventional external structure, inside which, in their central part, there is a vertical tube which does not contain powder and extends almost to the bottom of the hopper. Such a tube serves as a vent when the powder accidentally ignites in the lower part of the hopper.

Furthermore, a device is known which makes it possible to gradually reduce the level of the pressure which is established in enclosed spaces. Such a device comprises a flap which opens at the instant of the explosion and closes again afterwards. However, this device is especially suitable for installations conveying air which is capable of being charged with dust likely to form an explosive mixture with this conveyed air.

Finally, devices for protection against excess pressures will be mentioned, such as that described in French Pat. No. 1,407,819, which consist of covers arranged on the wall of the enclosure to be protected. Initially, in the case of excess pressure, a punch, joined to a membrane subjected to the said excess pressure, pierces the central part of the cover.

If this opening on the outside is not sufficient to release the excess pressure, the thin wall forming the cover is torn away from the hole which was previously pierced.

The state of the art therefore shows that there are devices which can be applied to hoppers for propellant powder and are capable of causing an abrupt drop in the pressure which is established therein when the powder accidentally ignites.

However, the disadvantage of these devices lies in the fact that, in the event of fire, the burning powder and structural elements of the hopper can be projected in all directions in a very random manner. Thus, the safety of the personnel and of the installations surrounding the hopper is not at all satisfactory. One meet the same kind of difficulties when using containers for propellant powders, or any other device for receiving or handling propellant powders.

The aim of the present invention is to overcome the abovementioned disadvantages by creating devices for receiving or handling propellant powders, such devices possessing an upper charging orifice, like hoppers of containers, capable of containing amounts of propellant powder which are greater than the critical volume, whilst being very safe to use and inexpensive to construct.

According to the invention, such a device is characterised in that it comprises a side vent possessing means for preventing the powder from escaping through this vent, and in that a zone in the side wall of the device, which is located approximately between the vent and the charging orifice, is made of a material which can be destroyed under the conjugate action of the pressure applied by the powder and the flames generated on the outside of the device near this zone.

The combination of the side vent and the destructible zone in the wall makes it possible, on the one hand, to avoid combustion and explosions in the event of fire, and, on the other hand, to ensure the safety of the personnel and of the surrounding installations by virtue of the fact that any burning materials can only be projected in a well-defined direction.

According to an advantageous version of the invention, the vent opens out on the outside as an orifice which is directed upwards and located in an approximately horizontal plane, and this vent is located in the lower part of the device.

Such an arrangement of the vent prevents the powder from escaping from the device because of the natural slope taken up by the external surface of the powder when the latter is charged.

Furthermore, the orientation of its orifice is such that the zone located between the said vent and the upper part of the device is destroyed very rapidly under the action of the flames which escape through the vent in the case where the powder ignites.

According to a preferred version of the invention, relating to hoppers possessing a lower flow orifice, the distance between the plane of the vent orifice and the plane of the flow orifice of the hopper is less than or equal to the critical combustion height of the powder. Any possibility of combustion, due to the charging height of the powder between the two abovementioned orifices, is thus avoided.

The destructible zone between the vent and the upper part of the device is preferably made of a combustible material. Thus, in the event of fire in the lower part of the device, the flames cause the combustion of the said zone of combustible material by escaping through the vent. This combustion very rapidly destroys this zone, with the result that the charge of powder is immediately discharged through the orifice created in the side wall of the device.

Further particular characteristics and advantages of the invention will also become apparent in the description which now follows.

In the attached drawings, which are given by way of non-limiting examples:

FIG. 3 is a view in perspective, with a cutaway section, of a variant of a hopper according to the invention;

FIG. 4 is a view in transverse section along the plane IV—IV of FIG. 3.

FIG. 5 is a view in perspective of a container according to the invention;

FIG. 6 is a view in traverse section along a plane perpendicular to the vent of the container shown in FIG. 5

Figure 1:
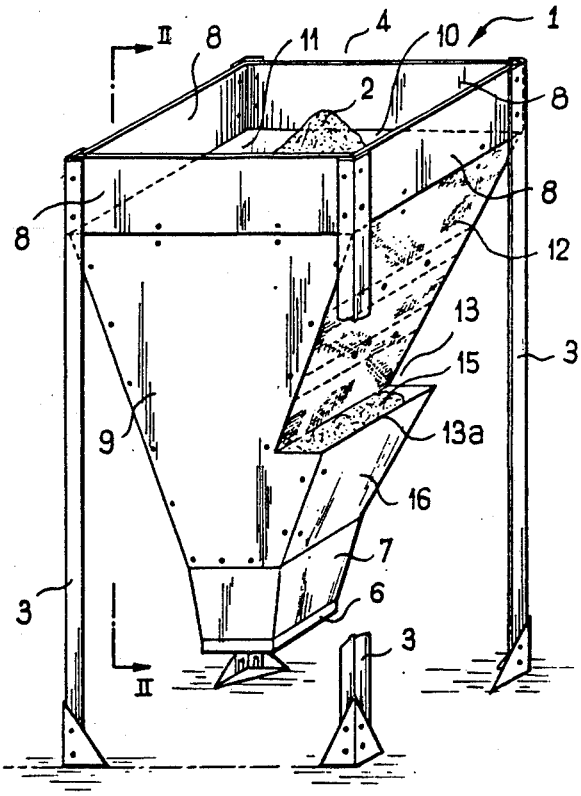
FIG. 1 is a view in perspective, with a cutaway section, of a hopper according to the invention.
Figure 2:
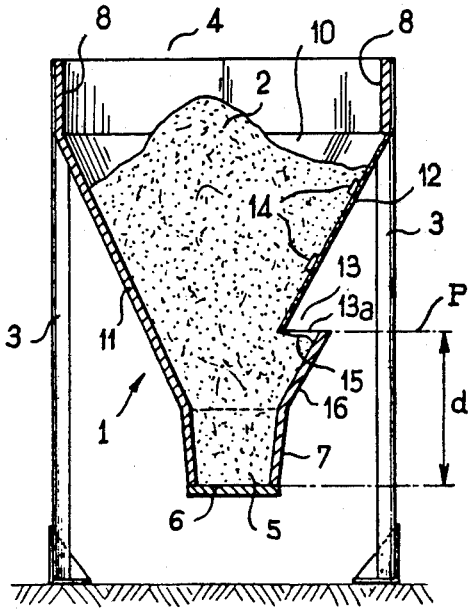
FIG. 2 is a view in longitudinal section along the plane II—II of FIG. 1.

In the embodiment of FIGS. 1 and 2, the hopper 1, which is essentially in the shape of a truncated pyramid, containing a propellant powder 2, is supported by four vertical stays 3. This hopper 1 possesses an upper charging orifice 4 and a lower flow orifice 5, for the powders 2, which flow orifice is blocked by a plate 6 in the example shown. This plate 6 is detachably mounted on the narrow lower part 7 of the hopper 1 by conventional means which are not shown. The total height of the hopper 1 is substantially greater than the critical combustion and explosion heights of the propellant powder 2 used.

The side wall of the hopper 1 consists of four rectangular upper plates 8, for example made of sheet steel, to which four essentially trapezoid side panels 9, 10, 11 and 12 are fixed.

According to the invention, the side wall of the hopper 1 possesses a vent 13, and a zone consisting of the panel 12, which extends between the vent 13 and the adjacent upper plate 8, is made of a combustible material such as a strong cotton gauze. In FIG. 2, the thickness of the panel 12 has been exaggerated in order to be shown more clearly.

The panel 12 of cotton gauze is sufficiently strong to support the charge of powder 2 which is contained in the hopper 1. this gauze panel 12 can be strengthened on the outside by means of wire netting fixed to the adjacent panels 9 and 10, or by means of cross-pieces 14, as indicated in FIG. 2.

In contrast to the panel 12, the side panels 9, 10 and 11 are made of an incombustible material such as sheet steel.

Furthermore, it is seen that the vent 13 opens out on the outside as an orifice 13*a* which is directed upwards and located in an approximately horizontal plane P. This arrangement prevents the powder 2 from escaping through the vent 13 because of the natural slope of the surface 15 of the powder 2 (see FIG. 2), which is taken up by the latter when it is charged into the hopper 1.

In addition, it is seen that the vent 13 is located near the narrow lower part 7 of the hopper 1, the distance d between the plane P of the vent orifice 13*a* and the plane of the flow orifice 5 preferably being less than or equal to the critical combustion height of the powder.

The orifice 13*a* of the vent 13 is adjacent to the lower edge of the gauze panel 12 and extends over the whole width of the abovementioned edge.

Furthermore, it is seen, especially in FIG. 2, that the external wall 16, which joins the narrow lower part 7 of the hopper 1 to the vent 13, is approximately parallel to the gauze panel 12.

The technical characteristics of the hopper 1 which has now been described are as follows:

In the event of accidental ignition of the powder 2 near the lower flow orifice 5, the pressure generated by the combustion is immediately released through the vent 13. Any danger of combustion or explosion, which would normally arise from the fact that the charging height of the powder is greater than the critical height, is thus avoided.

Furthermore, the flames generated by the combustion of the powder near the flow orifice 5 escape through the vent 13, immediately after ignition. Since this vent 13 is adjacent to the panel 12 of cotton gauze, the latter is immediately ignited by the flames which escape from the vent 13, which causes the rapid destruction of the panel 12. In this respect, the fact that the wall 16, located below the vent 13, is approximately parallel to the panel 12 ensures that the flames are directed towards this panel 12.

After destruction of the panel 12, the charge of powder 2 is discharged from the hopper through the hole created by the destruction of the panel 12. This powder 2, discharged from the hopper 1, thus causes a limited fire in the angular sector located opposite the panel 12.

A fire of this kind does not have any disastrous consequences because it is generated without any combustion and without the violent projection of burning, solid materials. Furthermore, this fire is produced under conditions and in a direction which are known in advance. Thus, the panel 12 of cotton gauze can be oriented towards a zone which is prohibited to personnel and does not contain any products or equipment which are capable of being destroyed by the abovementioned fire.

In the embodiment of FIGS. 5 and 6, the container consists of a box 31 in form of a parallelepiped constituted with four parallel walls and bottom. This box may be closed by a cover, said cover being not shown on the figures. The side wall 32 possesses a vent 33 which opens out on the outside as an orifice which is directed upwards and located in an inclined plane by reference with said wall 32. The vent is closed by a combustible cotton cloth 34 being fixed on the vent by metallic fixing means 35. The zone 36 located between the vent and the charging orifice consists of a destructible and combustible system in case the powder ignites. Said system comprises:

(a) a combustible cotton cloth 37 to prevent the propellant powder grains from escaping (b) a metallic grill 38

(c) a rigid expanded metal structure 39, (d) a rigid combustible plastic panel 310.

This system remains closed against the wall 32 through metallic fixing means 311 and 312.

When the container 31 is filled with propellant powder grains 313 and is closed with the above mentionned cover, in case said powder ignites, the flames destroy the combustible cloth 34 and ignite the zone 36 which destroys itself by burning of the panel 310 and of the cloth 37 and by tearing of the structure 39 and of the grill 38 under the action of the heat and of the pressure generated by the burning of the powder. The latter burns and falls out through the orifice created by the destruction of said zone 36 and so becomes located in a single direction without any risk of deflagration or detonation of the container while the powder burns in the open air.

NUMERICAL EXAMPLE

The invention was tested on a hopper which essentially corresponds to that shown in FIGS. 1 and 2. This hopper was charged with 725 kg of powder having a critical combustion height of between 0.2 and 0.3 meter and a critical explosion height of between 0.7 and 0.8 meter.

In the abovementioned experiment, the total height of powder in the hopper was of the order of 1.4 meters, that is to say almost double the critical explosion height and almost five times the critical combustion height.

The wall 12 of the hopper was made of cotton gauze of the same type as that used to make sacks for black gunpowder.

To simulate accidental ignition, the powder was ignited at the blocking orifice by means of a pyrotechnic ignition composition. The powder in the hopper caught fire about one second after ignition. The combustion of the powder lasted three to four seconds.

No pyrotechnic effect other than a relatively violent fire was observed. In particular, no sound effect and no deformation of the hopper were observed. The hoppper used in this test could be re-used after replacing the gauze of the wall 12.

The hopper according to the invention consequently offers considerably improved safety in use, compared with the known embodiments, since it not only removes the dangers of explosion or combustion by restricting them to a simple fire, but it also makes it possible to localise such a fire in a predetermined sector which is not dangerous and adjacent to the hopper.

Of course, the invention is not restricted to the example which has been described with reference to FIGS. 1 and 2, and this example can form the subject of numerous modifications without going outside the scope of the invention.

Thus, FIGS. 3 and 4 show a hopper 20 in the shape of a truncated cone. In this example, the side wall 21 of the hopper 20 possesses a side vent 22 which opens out on the outside as a crescent-shaped orifice 23, which is located in an approximately horizontal plane. The side wall 21 additionally comprises a portion 24 made of a combustible material such as gauze. This combustible portion 24 extends over a fraction of the circumference of the hopper 20, between the orifice 23 and the cylindrical upper part 25 of the hopper 20.

The technical characteristics of the hopper 20 are identical to those of the hopper 1 shown in FIGS 1 and 2.

The panel 12 of the hopper 1 and the portion 24 of the side wall 21 of the hopper 20 can be made of any other material which burns as rapidly as cotton gauze, provided that this material possesses sufficient strength to support the charge of powder. Thus, it would also be possible to use cardboard or a thin piece of relatively combustible wood or plastic.

Furthermore, it is not absolutely necessary for this material to be combustible. In fact, it suffices that the latter is destructible, that is to say it can tear on contact with the flames escaping from the vent 13 or 22. Thus, it is possible to use a thin piece of a thermoplastic material which, on contact with the flames, softens and then tears in order to release the mass of powder.

Furthermore, the orifice **13*a* or 23 of the vent 13 or 22** does not have to be located in a horizontal plane, provided that other means are envisaged for preventing the powder from escaping. These means could consist of a sieve having a sufficiently close mesh to retain the powder, whilst being loose enough not to oppose the escape of the flames.

I claim:

1. Device for receiving or handling a propellant powder, possessing an upper charging orifice for the powder, which comprises a side vent possessing means for preventing the powder from escaping through this vent, and a portion in the side wall of the device, which is located approximately between the vent and the charging orifice, made of a material which can be detroyed under the conjugate action of the pressure applied by the powder and the flames generated on the outside of the device near this zone.

2. Device according to claim 1, wherein the vent opens out on the outside as an orifice which is directed upwards and located in an approximately horizontal plane.

3. Device according to either one of claims 1 or 2, wherein the vent is located in the lower part of the device.

4. Device according to claim 1, wherein the said portion of destructible material extends over a limited part of the circumference of the device, this part being directed in the opposite direction from the normal position of those using the device.

5. Device according to claim 1, wherein the vent extends approximately over the whole width of the adjacent lower edge of the said portion.

6. Device according to claim 1, wherein the said destructible portion is made of a combustible material such as a gauze.

7. Device according to claim 1, wherein the portion between the vent and the upper part of the device is made of a thermoplastic material.

8. Device according to claim 1, wherein the device is a hopper possessing a lower flow orifice.

9. Device according to claim 8, wherein the distance between the plane of the orifice of the said vent and the plane of the flow orifice is less than or equal to the critical combustion height of the powder.

* * * * *